US005559509A

United States Patent [19]

Ogle

[11] Patent Number: 5,559,509

[45] Date of Patent: Sep. 24, 1996

[54] CROSS-WALK WARNING LIGHT SYSTEM

[76] Inventor: Terry B. Ogle, 1341 Dolly Parton Pkwy., Sevierville, Tenn. 37862

[21] Appl. No.: 369,902

[22] Filed: Jan. 9, 1995

[51] Int. Cl.[6] ..... G08G 1/095

[52] U.S. Cl. ..... 340/944; 340/925; 340/557; 340/691; 116/63 R

[58] Field of Search ..... 340/944, 908, 340/908.1, 925, 555, 557, 691; 116/63 R; 362/800

[56] References Cited

U.S. PATENT DOCUMENTS

| | | | |
|---|---|---|---|
| 2,700,754 | 1/1955 | McCullough | 340/116 |
| 3,199,073 | 8/1965 | Hilliker | 340/925 |
| 4,025,922 | 5/1977 | Trawick, III | 343/6.5 |
| 4,570,207 | 2/1986 | Takahashi et al. | 362/152 |
| 4,590,474 | 5/1986 | Patterson et al. | 340/944 |
| 5,103,223 | 4/1992 | Humphrey | 340/944 |
| 5,406,276 | 4/1995 | Ogle | 340/944 |

FOREIGN PATENT DOCUMENTS

| | | |
|---|---|---|
| 712131 | 9/1931 | France . |
| 3407929 | 9/1985 | Germany . |
| WO8700326 | 1/1987 | WIPO . |

*Primary Examiner*—Donnie L. Crosland
*Attorney, Agent, or Firm*—Pitts & Brittian, P.C.

[57] ABSTRACT

A cross-walk warning light system for warning drivers that a pedestrian has entered a cross-walk by shining a light, preferably a laser, having a beam parallel to the cross-walk. The cross-walk warning light system detects a pedestrian entering the cross-walk and activates a light that is aimed across the intersection, thus the driver sees this beam of light, which is projected across the intersection and is warned of the presence of a pedestrian in the cross-walk. The cross-walk warning light system is timed so as to deactivate the light after a predetermined interval of time. In the preferred embodiment, a first and an adjacent laser are spaced apart a distance substantially the width of the cross-walk, provide parallel beams of light on each side of the cross-walk. Also in the preferred embodiment, a second laser, disposed at the opposite end of the crosswalk, provides a second beam of light, aimed substantially co-linearly with the first. This allows at least a partial beam of light at each end of the cross-walk in the event a pedestrian blocks the first laser beam.

20 Claims, 5 Drawing Sheets

CROSS-WALK WARNING LIGHT SYSTEM

This application in part discloses and claims subject matter disclosed in my earlier filed pending application, Ser. No. 07/911,080, filed on Jul. 9, 1992, now U.S. Pat. No. 5,406,276.

TECHNICAL FIELD

This invention relates to the field of cross-walk warning lights. More specifically, it relates to a light system for warning drivers that a pedestrian is in an intersection or non-intersection cross-walk.

BACKGROUND ART

Pedestrian traffic as well as automobile traffic makes use of intersections in urban and suburban streets. As pedestrians travel from one location in a city to another, they are faced with many intersections which must be crossed. In order to assist the pedestrians in crossing safely, the familiar "WALK", "DON'T WALK" or the analogous iconographic signs are linked to standard motor-traffic controls. This allows pedestrians to, ideally, cross with, rather than perpendicular to, the flow of automobile traffic. While these controls, i.e. "WALK", "DON'T WALK" and iconographic pedestrian signs, warn pedestrian traffic of the safest opportunity to cross the intersection, they do not prevent a pedestrian from crossing against the light, i.e. entering the intersection when oncoming traffic has a "green light".

Also many urban areas and resort areas that have an especially heavy flow of pedestrian traffic have non-intersection cross-walks, i.e. cross-walks between intersections in which pedestrians always have the right of way. There are presently no warning light systems that warn oncoming traffic that a pedestrian is attempting to cross against the light or has entered a non-intersection cross-walk and is presently in the cross-walk. This need is most acute during periods of poor visibility when an alert driver would experience difficulty in spotting pedestrians.

Accordingly, it is an object of this invention to provide a cross-walk warning light system that is able to detect when a pedestrian has entered the cross-walk and accordingly activate a light or light system that warns drivers of oncoming traffic of the presence of a pedestrian in the cross-walk.

It is another object of this invention to provide a cross-walk warning light system that provides warning lights that are highly visible to oncoming traffic during periods of poor visibility, such as fog or inclement weather.

A further object of the present invention is to provide a cross-walk warning light system that illuminates the cross-walk area, including the pedestrians within the cross-walk area.

Other objects and advantages over the prior art will become apparent to those skilled in the art upon reading the detailed description together with the drawings as described as follows.

DISCLOSURE OF THE INVENTION

In accordance with the various features of this invention, a cross-walk warning light system is provided. The cross-walk warning light system detects a pedestrian entering the cross-walk and activates a light that is aimed across the street in order to project a beam of light from one end of the cross-walk to the other, thus the driver sees this beam of light and is warned of the presence of a pedestrian in the cross-walk. While any focused beam of light would suffice, a laser is the preferred light source. The light system is timed so as to deactivate the laser after a predetermined interval of time. In the preferred embodiment, two lasers, which are spaced apart a distance substantially the width of the cross-walk, provide parallel beams of light on each side of the cross-walk. Also in the preferred embodiment, a second laser, disposed at the opposite end of the crosswalk, provides a second beam of light, aimed substantially co-linearly with the first. This allows at least a partial beam of light at each end of the cross-walk in the event a pedestrian blocks the first laser beam. Also in the preferred embodiment, a pulsed yellow "caution" light beam would immediately precede a continuous red "stop" beam.

In an alternate embodiment, at least one scanner utilizing a focused beam of light, such as a laser, is disposed above the cross-walk and illuminates the cross-walk area by rapidly scanning the focused beam of light in a predetermined pattern such that light reflected from a pedestrian is seen by an approaching driver.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
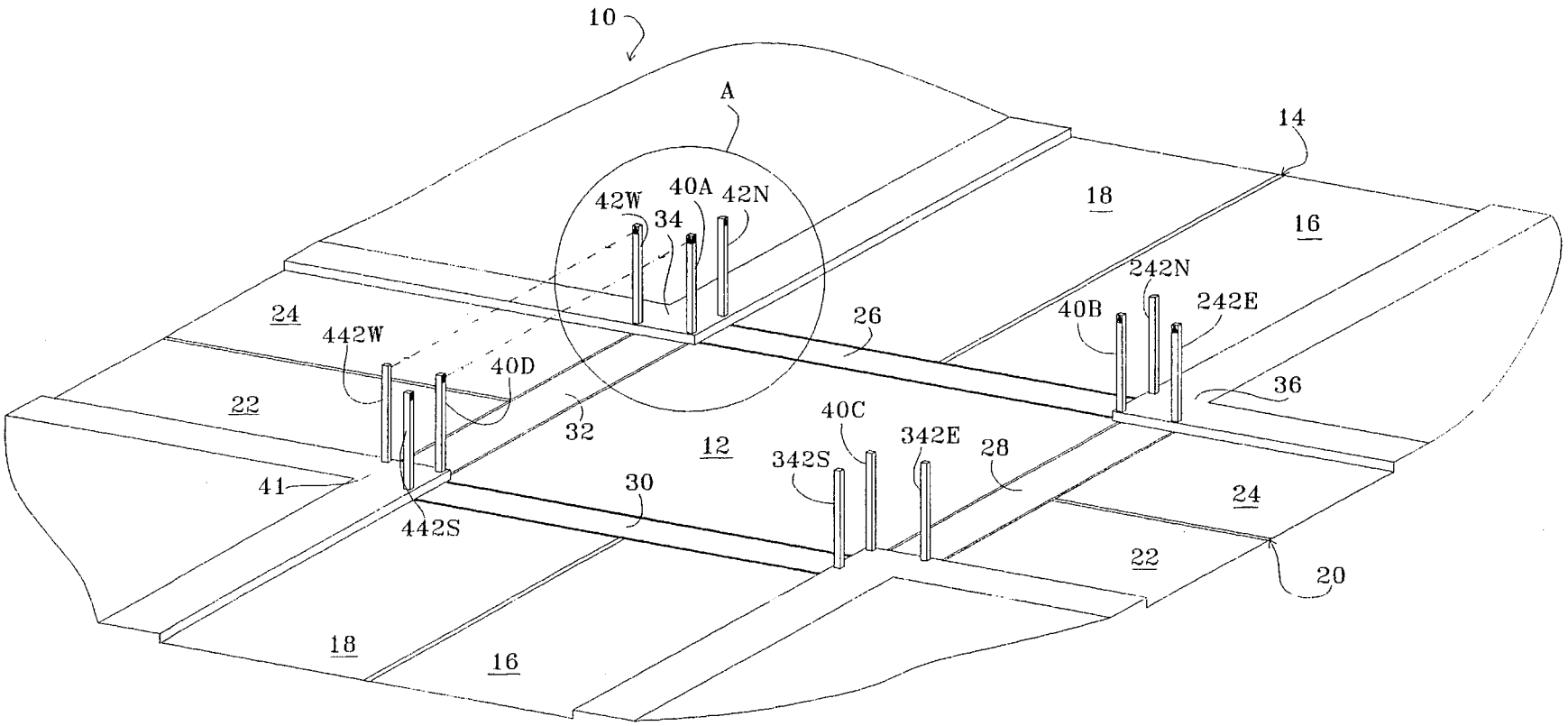
FIG. 1 illustrates a perspective view of an intersection equipped with the cross-walk warning light system of the present invention.

A cross-walk warning light system constructed in accordance with the present invention is illustrated generally as 10 in the Figures. For convenience and ease of illustration, the cross-walk warning light system is shown on an intersection 12 which consists of the junction of a first street 14, having a north bound lane 16 and a south bound lane 18, and a second street 20, having an east bound lane 22 and a west bound lane 24. To facilitate pedestrian traffic, intersection also has a northern cross-walk 26, an eastern cross-walk 28, a southern cross-walk 30 and a western cross-walk 32. Northern cross-walk 26 extends from northwestern corner 34 to northeastern corner 36. Likewise western cross-walk 32 extends from northwestern corner 34 to southwestern corner 41. It will be understood that references to direction are not intended to limit the disclosure, but are for ease of illustration. It will be further understood that intersection 12 could be equipped with standard traffic controls, such as the familiar red-yellow-green traffic lights (not shown) and could also be equipped with typical pedestrian controls, such as either the familiar "WALK"—"DON'T WALK" or analogous iconographic signs (not shown).

Figure 2:
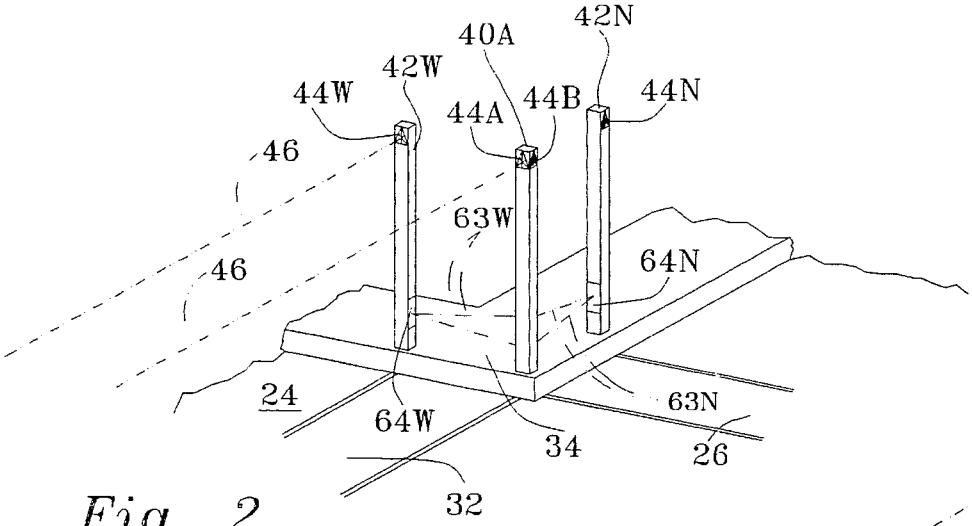
FIG. 2 illustrates a perspective view thereof taken at circle A of FIG. 1.
Figure 3:
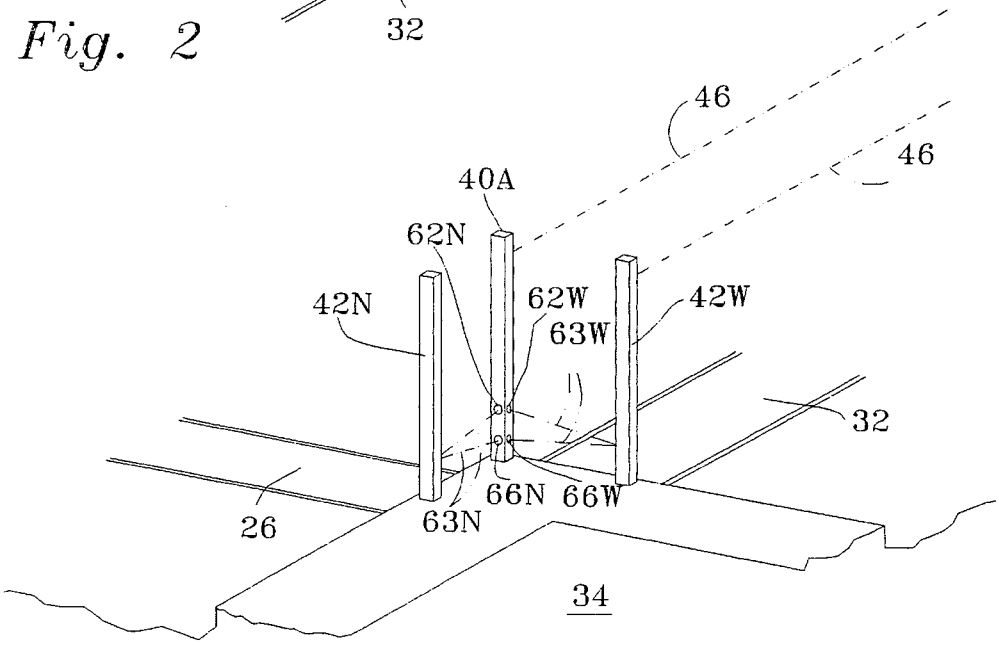
FIG. 3 illustrates a rear perspective view thereof taken at circle A of FIG. 1.

As a pedestrian enters a cross-walk, a laser emitter 44 emits a coherent beam of light 46 across the cross-walk so as to be visible to oncoming traffic. Also in the preferred embodiment, laser emitter 44 emits a pulsatile yellow "caution" beam immediately followed by a red "stop" beam. Laser emitter 44 is carried by a support pole 40, which is disposed at each corner. As can be seen in FIG. 2 and 3, support pole 40A is located on northwest corner 34. Support pole 40A carries two laser emitters, 44A, which is associated with western cross-walk and 44B, which is associated with northern cross-walk 26. It will be understood that support poles 40B, 400 and 40D also carry two laser emitters in like fashion. Preferably, each laser emitter carried by support poles 40A, 40B, 40C and 40D is aimed co-linearly with the other laser emitter associated with the same cross-walk, thus forming opposing pairs of laser emitters associated with each cross-walk.

Figure 6:
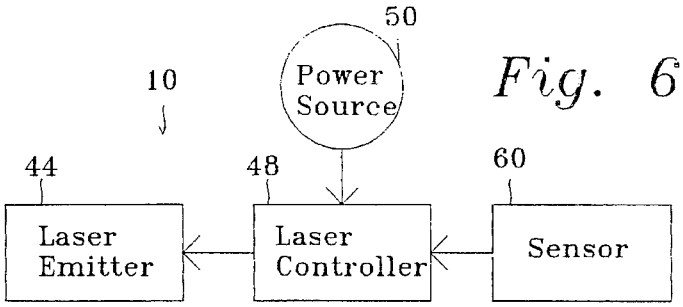
FIG. 6 illustrates a block diagram of the cross-walk warning light system of the present invention.

In the preferred embodiment support pole 42N is disposed a distance approximately equal the width of the northern cross-walk, to the north of support pole 40A. Support pole 42N also carries a laser emitter 44 which is associated with northern cross-walk 26. Support pole 42W is disposed a distance approximately the width of the western cross-walk, to the west of support pole 40A. In the preferred embodiment, support pole 42W also carries a laser emitter 44 which is associated with western cross-walk 32. While a specific support pole has been illustrated in the figures, it will be understood by those skilled in the art that a laser emitter 44 could be carried by an existing pole such as is used to carry any existing traffic/pedestrian control In FIG. 6 a block diagram is shown in which laser emitter 44 is controlled by laser controller 48, which receives signals from sensor 60. The system 10 is energized by power source 50. It will be recognized by those skilled in the art that power source 50 could be hardwired to the same power source as traffic controls, hardwired directly to main power leads, battery powered or solar generated through an array of solar cells.

Sensor 60 could in one embodiment be any type of motion sensor, a pressure-sensitive sensor pad such as is used by some automatic doors or even could be a manual push-button type device activated by the pedestrian. However, in the preferred, illustrated, embodiment, sensor 60 is an infrared light (IR) source 62, reflector 64 and IR detector 66. This type of sensor operates on the "broken beam" principle, i.e. a signal is generated by IR detector 66, in a negative feedback manner when IR beam 63 is broken and no longer detected by IR detector 66.

Reference is made to FIGS. 2 and 3 which illustrate an enlarged view of northwest corner 34. It will be understood that the configuration illustrated in FIGS. 2 and 3 and described below is, similarly, installed on the other respective corners, as is illustrated in FIG. 1. In the preferred embodiment, IR sources 62N and 62W are mounted a small distance, i.e. approximately 12–18 inches, above the ground on support pole 40. IR source 62N is focused towards reflector 64N, which is carried by support pole 42N. Likewise, IR source 62W is focused towards reflector 64W, which is carried by support pole 42W. IR source 62N emits IR beam 63N, which is then reflected by reflector 64N towards IR detector 66N. As a pedestrian steps into the northern cross-walk 26, IR beam 63N is momentarily broken. This causes sensor 60 to generate a signal which in turn causes laser controller 48 to activate laser emitter 44B and 44N. Similarly, if a pedestrian steps into the western cross-walk 32, IR beam 63W is momentarily broken. This causes sensor 60 to generate a signal which in turn causes laser controller 48 to activate laser emitter 44A and, in the preferred embodiment, 44W.

In a more preferred embodiment, laser controller 48 also activates the laser emitter carried by support pole 40D that is associated with western cross-walk 32 and the laser emitter carried by support pole 442W simultaneously with laser emitters 44A and 44W. Thus in the most preferred embodiment, opposing laser emitters, i.e. laser emitters that are aimed co-linearly and are associated with the same cross-walk, are activated simultaneously. This most preferred arrangement substantially prevents a light beam from being blocked by a pedestrian stepping in its path.

Figure 7:
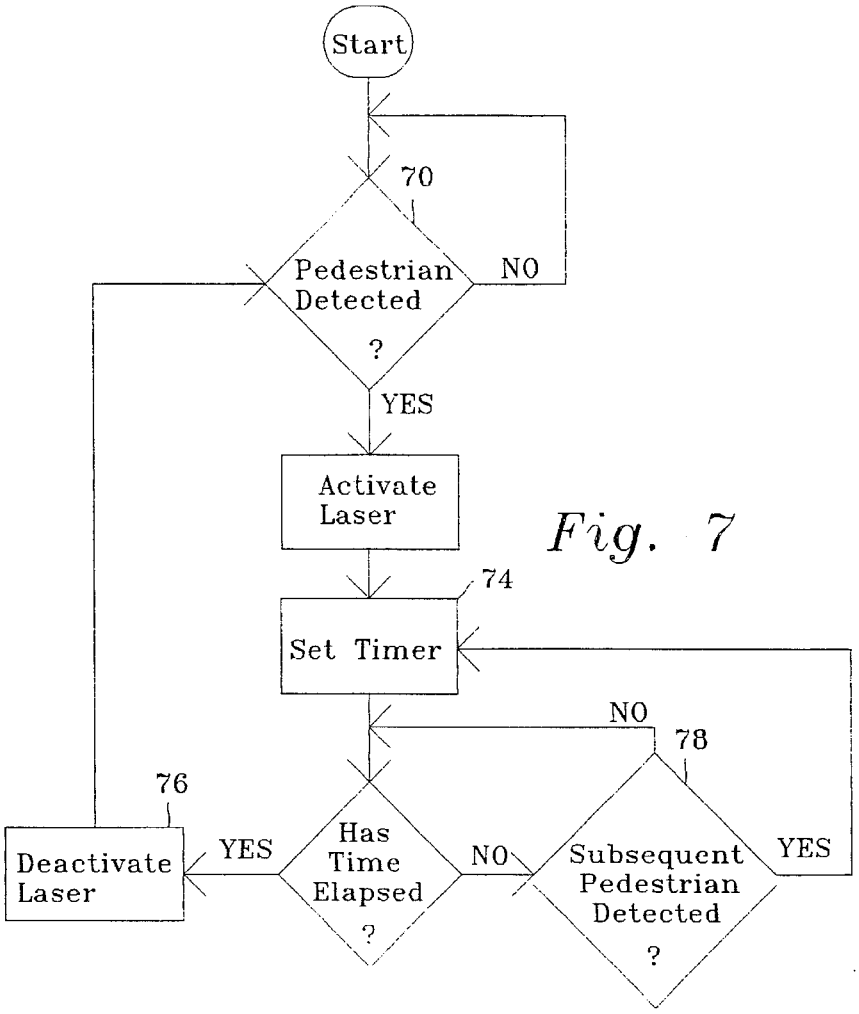
FIG. 7 a flow chart illustrating the operation of the controller of the warning light system of the present invention.

In addition to activating the various laser emitters, laser controller 48 also deactivates the laser emitters after a predetermined amount of time. In FIG. 7, a flow diagram illustrates the operation of laser controller 48. If a pedestrian is detected 70 by sensor 60, laser controller activates laser and sets a timer at 74. If the predetermined amount of time elapses prior to a subsequent pedestrian being detected, then the laser is deactivated 76. However, if a subsequent pedestrian is detected entering the cross-walk 78, the timer is re-set 74. In this fashion, laser controller 48 doesn't deactivate a laser emitter while a pedestrian is in the cross-walk.

Figure 4:
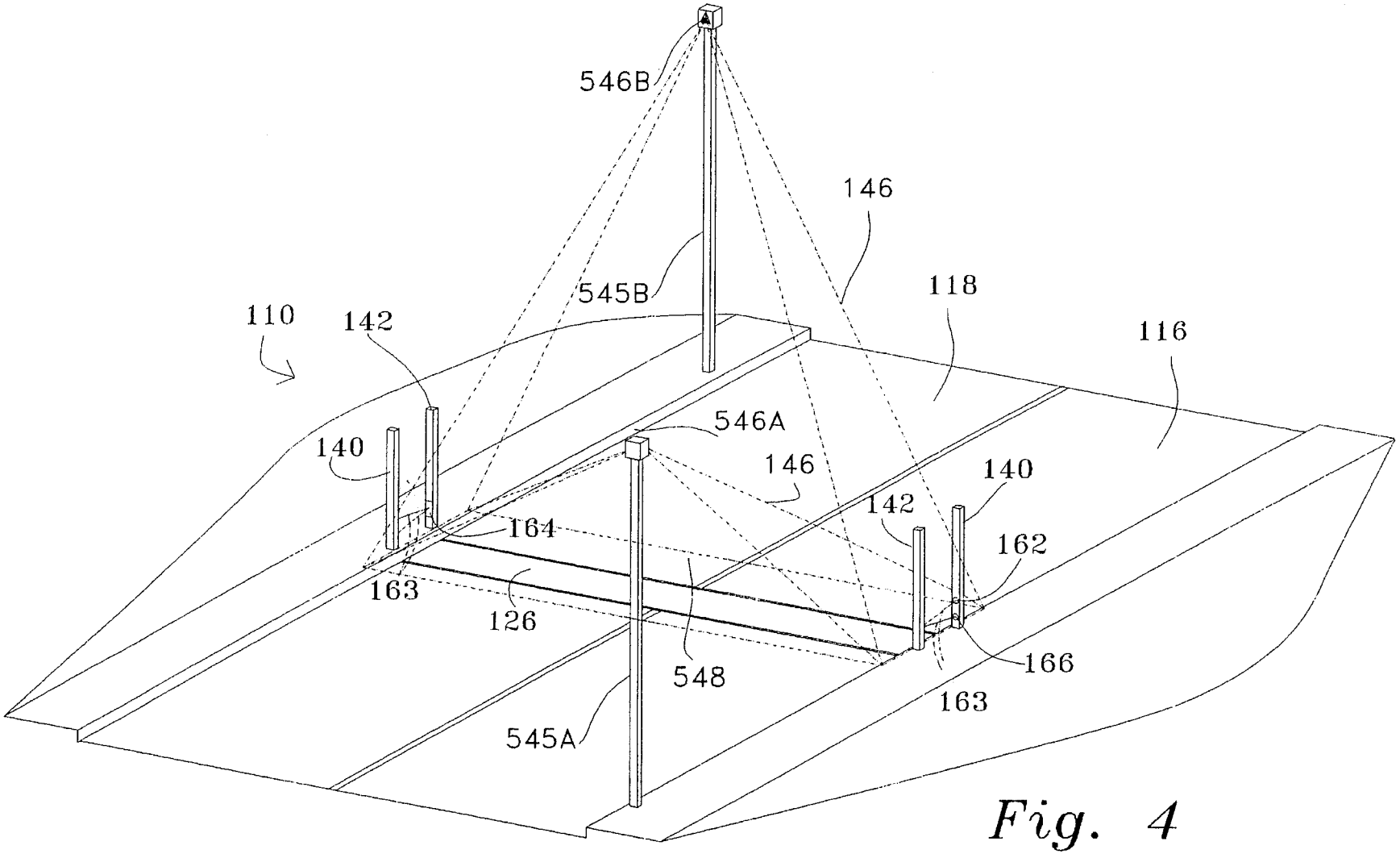
FIG. 4 illustrates perspective view of an alternate embodiment of the cross-walk warning light system utilizing the scanning lasers of the present invention installed at a non-intersection cross-walk.

An alternate embodiment of the present invention is illustrated in FIG. 4, in which cross-walk warning light system 110 utilizes a scanning laser. While system 110 is illustrated at a non-intersection cross-walk, those skilled in the art will recognize that system 110 could also be utilized at an intersection as described above. Those skilled in the art will also recognize that system 110 could also be utilized at a railroad crossing either in conjunction with or as a replacement of the traditional cross-bar, and that further, either system 10 or system 110 could be adapted to be a portable system. In system 110, IR source 162, IR beam 163, reflector 164 and IR detector 166 each function in the same manner as IR source 62, IR beam 63, reflector 64 and IR detector 66, respectively, in FIGS. 1–3.

Figure 5:
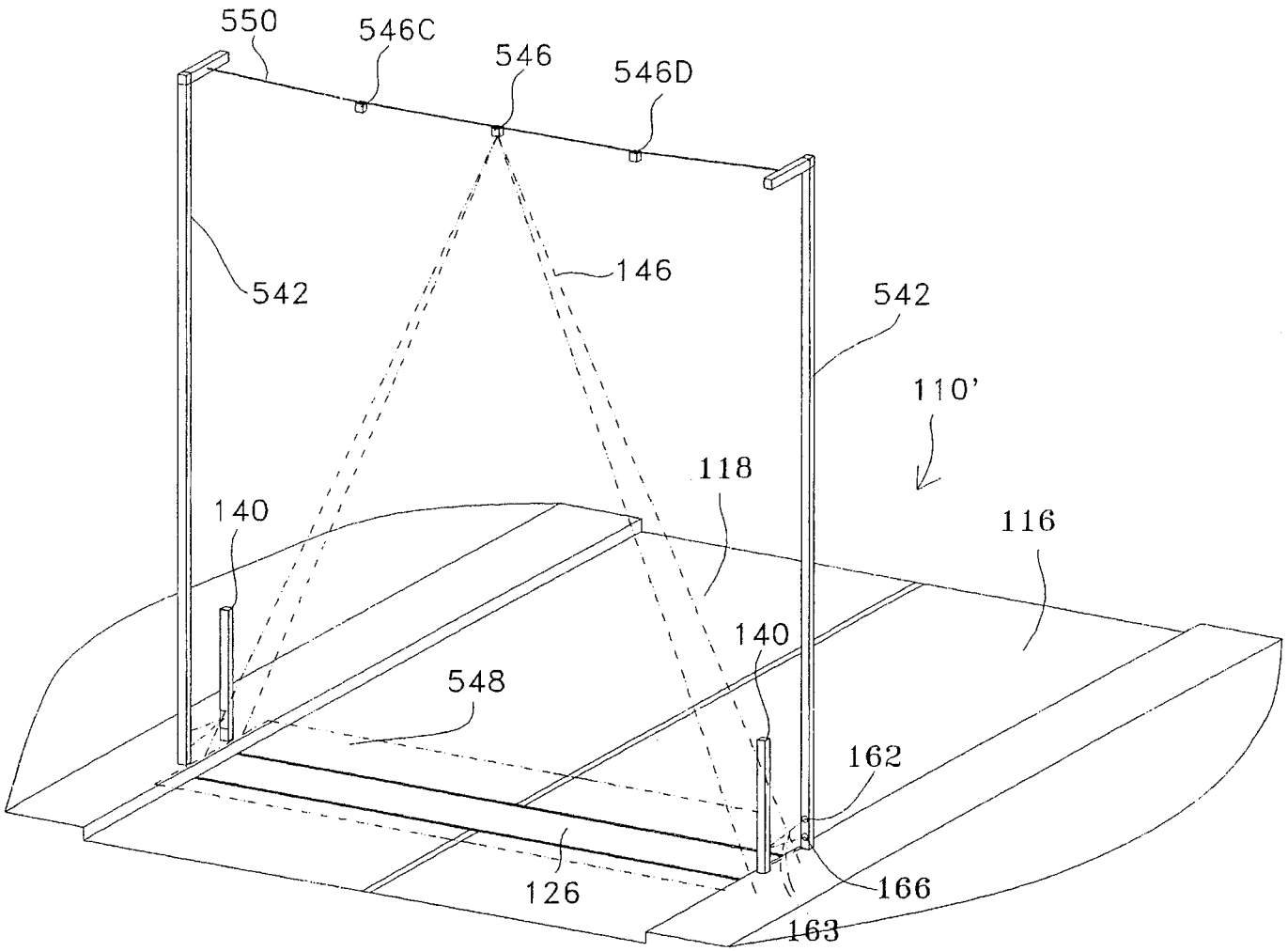
FIG. 5 illustrates perspective view of a further alternate embodiment of the cross-walk warning light system utilizing an overhead scanning beam of the present invention installed at a non-intersection cross-walk.

System 110 utilizes a scanning laser 546 which is supported by the upper end of scanner support 545. While a pole is illustrated, those skilled in the art will recognize that scanning laser 546 could be supported by other state of the art means such as a cantilevered horizontal support (not shown) or a cable such as cable 550 shown in FIG. 5. In the preferred embodiment for system 110, i.e. for highways in countries which drive on the right side of the highway, a scanner support 545 is positioned to the right, from a driver's perspective, of lane 118 and a further scanner support 545 is positioned to the right, again from a driver's perspective, of lane 116. It will be recognized that in countries which drive on the left side of the road, scanner supports 545 will be positioned to the driver's left. Thus, in the preferred embodiment, scanner supports 545 are positioned such that scanning laser 546 is aimed in the direction of travel of an automobile (not shown). IR source 162 emits IR beam 163, which is then reflected by reflector 164 towards IR detector 166. As a pedestrian steps into cross-walk 126, IR beam 163 is momentarily broken. Sensor 60 then generates a signal which activates scanning laser 546. Scanning laser 546 rapidly scans, or "paints", paint area 548 with laser light beam 146. It will be recognized that scanning laser 546 could be any scanning collimated beam or coherent beam of light. Those skilled in the art will recognize that while laser 546 could be either a Class I, Class II, Class III or Class IV laser, a Class II, Class III or Class IV laser is preferred. Those skilled in the art will recognize that a pedestrian in paint area 548 will be illuminated by scanning laser 546 and will be visible to oncoming traffic. In the preferred embodiment of system 110, paint area 548 extends the entire length of cross-walk 126 so that a driver will be able to see pedestrians in the driver's lane as well as pedestrians about to enter that lane. Further, paint area 548 is wider than cross-walk 126 in order to account for the height of pedestrians near the boundary of cross-walk 126. Further in the preferred embodiment of system 110, paint area 548 is scanned, "painted" with scanning lasers 546A and 546B from both directions of traffic, i.e. scanner support 545A is positioned to the right of lane 116 and scanner support 545B is positioned to the right of lane 118, such that pedestrians in the cross-walk will be visible to both directions of traffic. However, those skilled in the art will recognize that a single scanner support 545 and scanning laser 546 could be utilized. It will also be recognized by those skilled in the art, that in systems using a plurality of scanning lasers 546, separate scanning lasers 546 could scan separate paint areas. As in the first embodiment, laser controller 48 deactivates scanning laser 546 after a predetermined amount of time. An alternate embodiment of system 110 is designated 110' in FIG. 5. In system 110', support poles 542 are in spaced relation to one another and are configured so as to suspend scanning laser 546, preferably by means of a cable 550, directly above cross-walk 126. It will be recognized by those skilled in the art that scanning laser 546 could be suspended directly above cross-walk 126 by other state of the art means such as a cantilevered horizontal support (not shown). In areas where cross-walk 126 crosses a six-lane road (not shown) or a divided road (not shown), a pair of scanning lasers, 546C and 546D could be utilized in spaced relation to each other. Those skilled in the art will readily recognize that scanning laser 546, in either system 110 or system 110', is dependent upon a power supply such as power supply 50.

Figure 8:
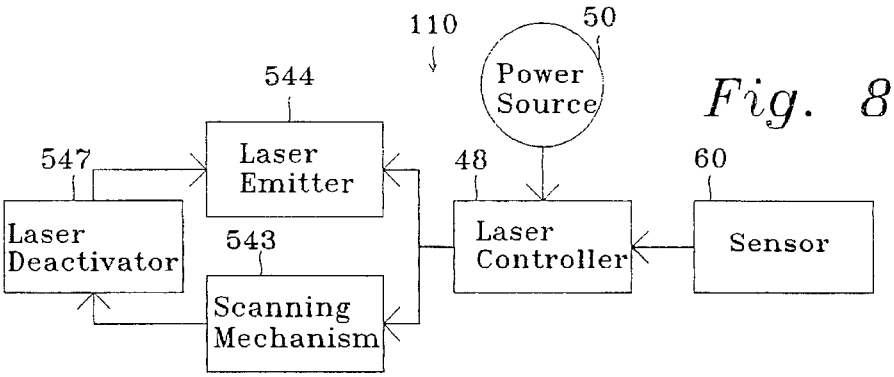
FIG. 8 illustrates an alternate block diagram of the cross-walk warning light system of the present invention.

Those skilled in the art recognize that scanning laser 546 consists of a laser source 544 in conjunction with a scanning mechanism 543, see FIG. 8. As described above, laser controller 48, receives signals from sensor 60 and in turn activates scanning mechanism 543 and laser source 544. System 110 and 110' is energized by power source 50. In order to prevent laser source 544 from being activated if scanning mechanism 543 is inactive, laser deactivator 547 deactivates activates laser source 544 only if scanning mechanism 543_ ceases operating, i.e. ceases scanning. In this regard laser deactivator 547 is state of the art electronic circuitry or processing circuitry.

From the foregoing description, it will be recognized by those skilled in the art that a cross-walk warning light system offering advantages over the prior art has been provided. Specifically, the cross-walk warning light system provides a system that is able to detect when a pedestrian has entered the cross-walk and accordingly activate lights that warn oncoming traffic of the presence of a pedestrian in the cross-walk and also provides warning lights that are highly visible to oncoming traffic during periods of poor visibility, such as fog or inclement weather.

While a preferred and alternate embodiments have been shown and described, it will be understood that they are not intended to limit the disclosure, but rather the disclosure is intended to cover all modifications and alternate methods falling within the spirit and the scope of the invention as defined in the appended claims.

Having thus described the aforementioned invention, I claim:

1. A crosswalk warning light system for giving visual indication to motor traffic on a selected road that at least one pedestrian is within a crosswalk crossing the selected road by illuminating the cross-walk and objects therein, the crosswalk terminating at first and second ends on either side of the road and defining first and second side boundaries, said crosswalk warning light system comprising:

a power supply;

at least a first scanning laser vertically spaced from ground for scanning at least a portion of said cross-walk with at least a portion of said visual indication, said scanned portion defining a paint area, said portion of said visual indication including at least a first scanning beam of laser light;

at least a first scanning laser support for supporting said first scanning laser above and proximate said cross-walk such that said first scanning laser illuminates said paint area;

a sensor for detecting at least one pedestrian entering said crosswalk at either of said first and second ends of said crosswalk; and a controller for activating and deactivating said first scanning laser, said controller activating said first scanning laser upon detection by said sensor of at least one pedestrian entering said crosswalk.

2. The crosswalk warning light system of claim 1 further comprising:

at least a second scanning laser vertically spaced from ground for scanning at least a portion of said cross-walk with at least a portion of said visual indication, said scanned portion defining a paint area, said portion of said visual indication including at least a second scanning beam of laser light; and at least a second scanning laser support for supporting said first scanning laser above and proximate said cross-walk such that said second scanning laser illuminates said paint area.

3. The crosswalk warning light system of claim 1 wherein said first scanning laser is positioned in spaced relation from said cross-walk such that said first scanning beam of laser light is projected into said cross-walk in the direction of oncoming traffic.

4. The crosswalk warning light system of claim 2 wherein said second scanning laser is positioned in spaced relation from said cross-walk such that said second scanning beam of laser light and said second beam of light is projected into said cross-walk in the direction of oncoming traffic.

5. The crosswalk warning light system of claim 1 wherein said second scanning laser is positioned directly above said cross-walk.

6. The crosswalk warning light system of claim 1 wherein said first scanning beam of laser light is a class I laser beam defining a selectable wavelength.

7. The crosswalk warning light system of claim 1 wherein said first scanning beam of laser light is a class II laser beam defining a selectable wavelength.

8. The crosswalk warning light system of claim 1 wherein said first scanning beam of laser light is a class III laser beam defining a selectable wavelength.

9. The crosswalk warning light system of claim 1 wherein said first scanning beam of laser light is a class IV laser beam defining a selectable wavelength.

10. The crosswalk warning light system of claim 1 further comprising electronic circuitry for deactivating said first scanning laser when said first scanning laser is not scanning.

11. The crosswalk warning light system of claim 1 wherein said first scanning laser support is a cable.

12. The crosswalk warning light system of claim 1 wherein said first scanning laser support has an upper end and a lower end and further wherein said first scanning laser is carried by said upper end.

13. A crosswalk warning light system for giving visual indication to motor traffic on a selected road that at least one pedestrian is within a crosswalk crossing the selected road by illuminating the cross-walk and objects therein, the crosswalk terminating at first and second ends on either side of the road and defining first and second side boundaries, said crosswalk warning light system comprising:

a power supply;

a first scanning laser support disposed at said first end of said crosswalk proximate said first side boundary, said first scanning laser support having an upper end and a lower end;

a first scanning laser carried by said first scanning laser support vertically spaced from ground for scanning at least a portion of said cross-walk with at least a portion of said visual indication, said scanned portion defining a paint area, said portion of said visual indication including at least a first scanning beam of laser light;

a second scanning laser support disposed at said second end of said crosswalk proximate said second side boundary, said second scanning laser support having an upper end and a lower end;

a second scanning laser carried by said second scanning laser support vertically spaced from ground for scanning at least a portion of said cross-walk with at least a portion of said visual indication, said scanned portion defining a paint area, said portion of said visual indication including at least a second scanning beam of laser light;

a sensor for detecting at least one pedestrian entering said crosswalk at either of said first and second ends of said crosswalk; and a controller for activating and deactivating said first scanning laser, said controller activating said first scanning laser upon detection by said sensor of at least one pedestrian entering said crosswalk.

14. The crosswalk warning light system of claim 13 wherein said first scanning laser is positioned in spaced relation from said cross-walk such that said first scanning beam of laser light is projected into said cross-walk in a first direction of a lane of traffic; and wherein said second scanning laser is positioned in spaced relation from said cross-walk such that said second scanning beam of laser light and said second beam of light is projected into said cross-walk in the direction of a second lane of traffic travelling in an opposite direction.

15. The crosswalk warning light system of claim 13 wherein said first scanning beam of laser light is a class I laser beam defining a selectable wavelength.

16. The crosswalk warning light system of claim 13 wherein said first scanning beam of laser light is a class II laser beam defining a selectable wavelength.

17. The crosswalk warning light system of claim 13 wherein said first scanning beam of laser light is a class III laser beam defining a selectable wavelength.

18. The crosswalk warning light system of claim 13 wherein said first scanning beam of laser light is a class IV laser beam defining a selectable wavelength.

19. A crosswalk warning light system for giving visual indication to motor traffic on a selected road that at least one pedestrian is within a crosswalk crossing the selected road, the crosswalk terminating at first and second ends on either side of the road and defining first and second side boundaries, said crosswalk warning light system comprising:

a power supply;

a first laser support disposed at said first end of said crosswalk proximate said first side boundary, said first laser support having an upper end and a lower end;

a first laser carried by said first laser support vertically spaced from ground for projecting at least a portion of said visual indication across said road in a direction substantially parallel to said crosswalk and proximate said first side boundary, said portion of said visual indication including at least a first coherent beam of light;

a second laser support disposed at said second end of said crosswalk proximate said first side boundary, said second laser support having an upper end and a lower end;

a second laser carried by said second laser support vertically spaced from ground for projecting at least a portion of said visual indication across said road in a direction substantially parallel to said crosswalk and proximate said second side boundary, said portion of said visual indication including at least a second coherent beam of light co-linearly aimed with said first coherent beam of light;

a sensor for detecting at least one pedestrian entering said crosswalk at either of said first and second ends of said crosswalk; and a controller for activating and deactivating said first laser and said second laser, said controller activating said first laser and said second laser upon detection by said sensor of at least one pedestrian entering said crosswalk.

20. The crosswalk warning light system of claim 19 further comprising:

a third laser support disposed at said first end of said crosswalk proximate said second side boundary, said third laser support having an upper end and a lower end;

a third laser carried by said third laser support vertically spaced from ground for projecting at least a portion of said visual indication across said road in a direction substantially parallel to said crosswalk and proximate said second side boundary, said portion of said visual indication including at least a third coherent beam of light;

a fourth laser support disposed at said second end of said crosswalk proximate said second side boundary, said fourth laser support having an upper end and a lower end; and a fourth laser carried by said fourth laser support vertically spaced from ground for projecting at least a portion of said visual indication across said road in a direction substantially parallel to said crosswalk and proximate said second side boundary, said portion of said visual indication including at least a fourth coherent beam of light co-linearly aimed with said third coherent beam of light, said controller activating said third laser and said fourth laser upon detection by said sensor of at least one pedestrian entering said crosswalk.

* * * * *